US008696174B2

(12) United States Patent
Shpizel

(10) Patent No.: US 8,696,174 B2
(45) Date of Patent: Apr. 15, 2014

(54) FLASHLIGHT WITH IMPROVED OPTICAL DENSITY

(76) Inventor: Matvey B. Shpizel, Brooklyn, NY (US)

( * ) Notice: Subject to any disclaimer, the term of this patent is extended or adjusted under 35 U.S.C. 154(b) by 0 days.

(21) Appl. No.: 12/369,834

(22) Filed: Feb. 12, 2009

(65) Prior Publication Data

US 2010/0027251 A1 Feb. 4, 2010

Related U.S. Application Data

(60) Provisional application No. 61/086,078, filed on Aug. 4, 2008.

(51) Int. Cl.
*F21V 33/00* (2006.01)

(52) U.S. Cl.
USPC ..... 362/331; 362/326; 362/157

(58) Field of Classification Search
USPC ..... 362/187, 188, 331, 326, 311.02
See application file for complete search history.

(56) References Cited

U.S. PATENT DOCUMENTS

| | | | | |
|---|---|---|---|---|
| 1,823,762 | A | 5/1930 | Rathmann | |
| 2,228,078 | A | 10/1938 | Gulliksen | |
| 2,604,002 | A | 11/1944 | Wengel | |
| 3,024,365 | A | 4/1959 | Smith et al. | |
| 3,294,470 | A | 12/1966 | Dakin et al. | |
| 3,447,874 | A | 6/1969 | Back | |
| 4,286,311 | A | 8/1981 | Maglica | |
| 4,527,223 | A | 7/1985 | Maglica | |
| 4,562,350 | A | 12/1985 | Thirouard et al. | |
| 5,144,479 | A | 9/1992 | Aharon et al. | |
| 5,900,987 | A * | 5/1999 | Kreitzer | 359/649 |
| 5,918,968 | A | 7/1999 | Choi | |
| 6,604,843 | B2 | 8/2003 | Shpizel | |
| 6,741,404 | B2 * | 5/2004 | Ue et al. | 359/811 |
| 6,827,475 | B2 | 12/2004 | Vetorino et al. | |
| 7,019,877 | B2 | 3/2006 | Shpizel et al. | |
| 7,036,935 | B2 | 5/2006 | Shpizel | |
| 7,083,297 | B2 | 8/2006 | Matthews et al. | |
| 7,083,299 | B2 * | 8/2006 | Chapman | 362/188 |
| 7,175,316 | B2 | 2/2007 | Shpizel | |
| 2007/0133200 | A1 * | 6/2007 | Uke et al. | 362/202 |

* cited by examiner

*Primary Examiner* — Laura Tso
(74) *Attorney, Agent, or Firm* — Kirk A. Buhler; Buhler & Associates

(57) ABSTRACT

An improved flashlight is disclosed which includes an a power supply a light source and a lens projection system, wherein the lens projection system including a collecting lens, a negative lens, and a collimating lens such that the illuminance of an area illuminated by a beam projected by the improved flash light is homogeneous throughout the whole of the illuminated area.

20 Claims, 7 Drawing Sheets

FLASHLIGHT WITH IMPROVED OPTICAL DENSITY

This application claims priority from copending Provisional Patent Application Ser. No. 61/086,078, filed Aug. 4, 2008, and entitled Flashlight With Improved Optical Density.

FIELD OF THE INVENTION

This invention relates to a light source, and more particularly to a flashlight with improved beam optical density.

BACKGROUND OF THE INVENTION

Collimators are well known in the optical arts, and typically include a plurality of lens or reflectors that act upon light to emit nearly parallel rays. Such collimators include searchlights, headlamps and light projectors. A typical example of a light projector designed to emit a collimated beam can be found in U.S. Pat. No. 5,918,968, issued to Choi, which provides a parabolic reflector for converting light emitted from a lamp to parallel rays, a biconvex lens for collimating both direct and reflected light from the light source, a combination lens having a first lens and a second lens for focusing the collimated light from the biconvex lens to a focal point, and an image lens located beyond the focal point for converting the light focused at the focal point into a parallel beam.

U.S. Pat. No. 6,827,475, issued to Vetorino et al., combines a plurality of lens and reflectors to collimate light that includes a conical reflector disposed about the base of a light emitting diode (LED) and a lens specially designed to focus the collected light into a nearly collimated beam. The lens has opposite, substantially elliptical surfaces that collect and collimate the rapidly diverging light from the LED and the reflector. Vetorino et al., however, do not provide for the compression of the collimated beam.

It is also known in the art that the illuminance Lx of a light stream from a light source located perpendicular to an area, illuminates that area according to the following relationship: $Lx=Lm/m^2$. For example, one Lx of illuminance is equal to one Lm of luminous flux for an illuminated surface measuring one square meter in area, and with the light source arranged perpendicular to the surface. In another example, if the luminous flux is equal to 1,000 Lm and the uniformly illuminated surface is one square meter, then the illuminance of that area equals 1,000 Lx. Thus, in order to measure the luminous flux in a uniformly illuminated area of 1.0 square meters, a Lux Meter may be placed anywhere in the illuminated area.

Some prior art producers of light sources, e.g., prior art flashlights utilizing light emitting diodes (LED) claim values of luminous flux (Lm) which in some instances appear higher than the maximum value that can be emitted by the light emitting diode in all directions. Such claims do not account for the uniformity of illuminance (Lx) of an illuminated area where the measurement was taken. Experimentally, the illuminance of two prior art LED's, have been measured and compared to their maximum luminous flux. Two prior art flashlights were chosen for the measurement: (1) ND HB F5, 6V, 2CR 123, 107 Lm Cree LED (hereinafter "HB F5"), and (2) NH HB VIGOUR, 6V, 2CR 123, 107 Lm Cree LED (hereinafter "HB VIGOUR"). Each flashlight having substantially identical electrical specifications, but different optical schematics. The HB F5 appears to utilize an optical schematic that allows for concentrated light emission with uniform luminous flux through the light stream and a +/−2.5° angle of dispersion relative to the optical axis. The HB VIGOUR utilizes a focusing output lens system.

FIGS. 1*a* and 1*b* correspond to the illuminated fields of the HB VIGOUR and HB F5, respectively. Although, the illuminated area of fields 1*a* and 1*b* were each 1.0 $m^2$, the distance of the flashlights to the illuminated surface varied. HB VIGOUR was located a distance of five meters from the illuminated area, corresponding to illuminated field "1*a*"; whereas, HB F5 was located a distance of 10.5 meters from the illuminated area, corresponding to illuminated field "1*b*". The distribution of illuminance throughout the illuminated fields 1*a* and 1*b* is given by $Lx=Lm/m^2$ as illustrated by FIG. 2.

Curve A of FIG. 2 represents the distribution of illuminance of the HB F5 having an illuminated area of 1.0 square meter at a distance of 10.5 meter from the illuminated surface. It can be seen that the maximum luminous flux for curve A is about 135 Lm. Curve B of FIG. 2 represents the distribution of illuminance of the HB VIGOUR having an illuminated area of 1 square meters at a distance of 5.0 meters from the illuminated surface. It can be seen that the maximum luminous flux for curve B is about 80 Lm. Dotted line C of FIG. 2 represents the theoretical maximum luminous flux, 107 Lm, of the LED used in both the HB F5 and HB VIGOUR.

The area under curve A, S1, is calculated as follows: $Y=1/\sqrt{2n}\exp(-x2/2)$. Solving for S1 from −56 to +56: $\int[1/\sqrt{2n}\exp(-x2/2)]dx=7{,}795$ units. The area under curve B, $S_2$, is $112\times80=8{,}960$ units. It can be seen that $S_1$ is smaller than $S_2$, and $S_1/S_2=0.87$. Thus, the luminous flux of curve A is equal to 87% of 80 Lm which is 70 Lm, but not 135 Lm as some flashlight manufacturers claim. Thus the uniformity distributed luminous flux cannot exceed the value of 107 $L_m$ because this value is the maximum output of the LED used in both flashlights.

Other light sources include flashlights which typically comprise a light source, a reflector located behind the light source, a lens or glass in front of the reflector, and a power supply. The reflector and the lens are intended to collect light from the source and collimate or focus the light into a desired beam. Such light sources are often portable, and generally produce a diverging beam of light whereby the brightness varies across the beam. Typically, the light beam is brightness at its center, and drops off dramatically at its peripheral edge. Examples of such prior art lights may be found in U.S. Pat. Nos. 1,823,762; 2,228,078; 4,286,311; and 4,527,223.

An important advantage of the present invention is the provision of a light device where the light beam is minimally divergent or compressed along the optical axis, thereby allowing for increased intensity over an illumination range of interest.

SUMMARY OF THE INVENTION

The present invention provides a flashlight comprising a power supply, a light source for emitting light, a collecting lens for gathering and compressing the light from the light source, a negative lens for diverging the light, a collimating lens for projecting the light along a ray parallel with an optical axis, and a housing for mounting each component therein. In one embodiment, a flashlight is provided that includes a power supply, a light source, an adjustable collecting lens for gathering and compressing the light from the light source, a negative lens for diverging the light, a collimating lens for projecting the light along a ray at an adjustable angle with an optical axis, and a housing for mounting each component therein.

BRIEF DESCRIPTION OF THE DRAWINGS

These and other features and advantages of the present invention will be more fully disclosed in, or rendered obvious by, the following detailed description of the preferred embodiment of the invention, which is be considered together with the accompanying drawings wherein like numbers refer to like parts and further wherein.

DETAILED DESCRIPTION OF THE PREFERRED EMBODIMENT

Figure 1A:
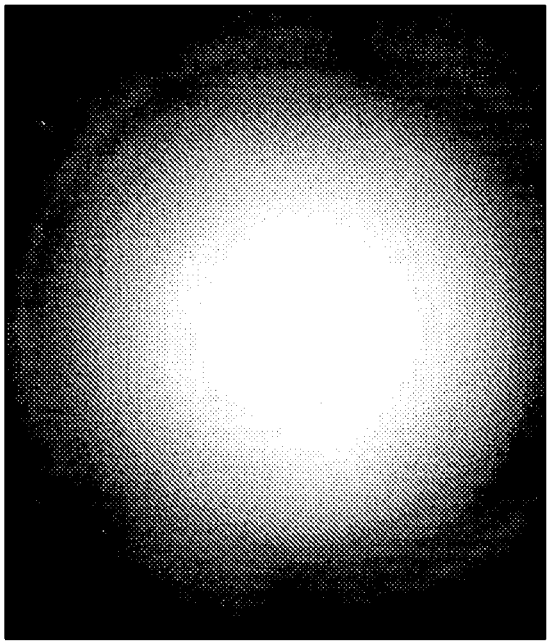
FIG. 1a (PRIOR ART)
FIGS. 1*a* and 1*b* illustrate the illuminated field of a prior art light source and a light source formed in accordance with the present invention.
Figure 1B:
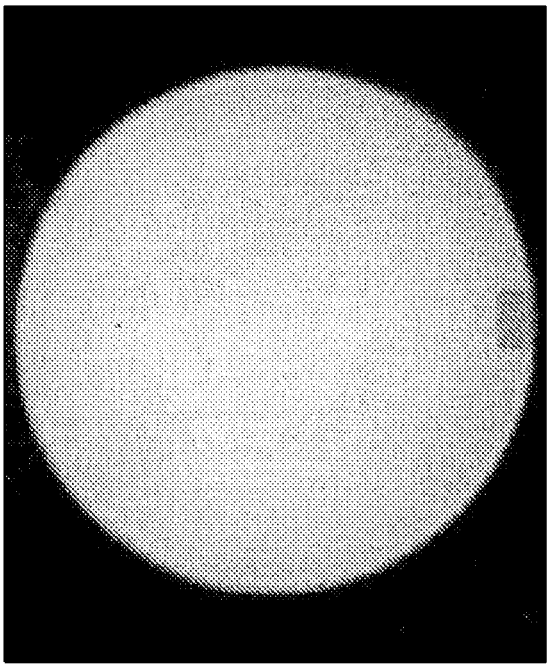
Figure 2:
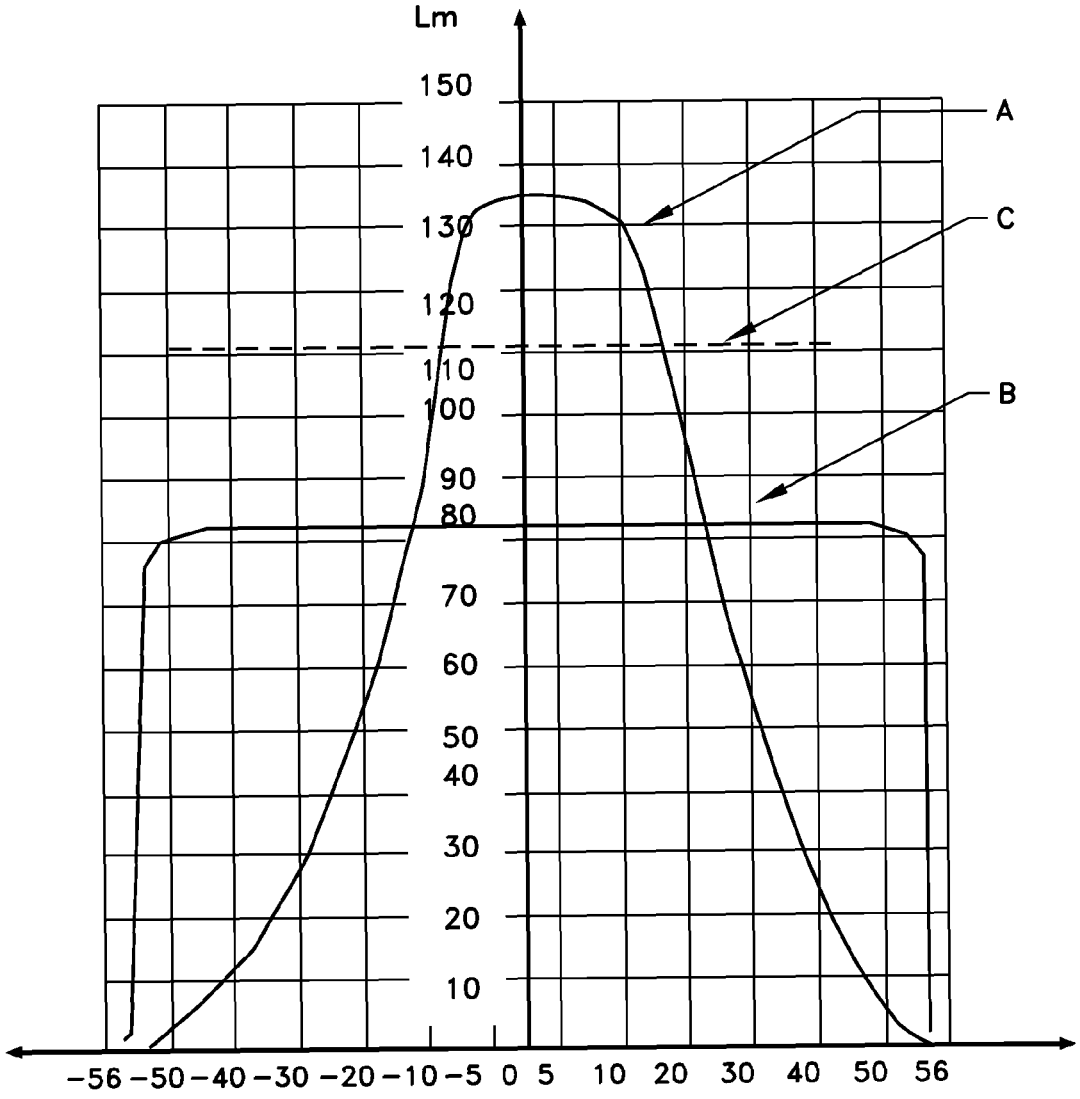
FIG. 2 is graph comparing the illuminance of a prior art light source and a light source formed in accordance with the present invention.

This description of preferred embodiments is intended to be read in connection with the accompanying drawings, which are to be considered part of the entire written description of this invention. The drawing figures are not necessarily to scale and certain features of the invention may be shown exaggerated in scale or in somewhat schematic form in the interest of clarity and conciseness. In the description, relative terms such as "horizontal," "vertical," "up," "down," "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship. In the claims, means-plus-function clauses, if used, are intended to cover the structures described, suggested, or rendered obvious by the written description or drawings for performing the recited function, including not only structural equivalents but also equivalent structures.

Figure 3:
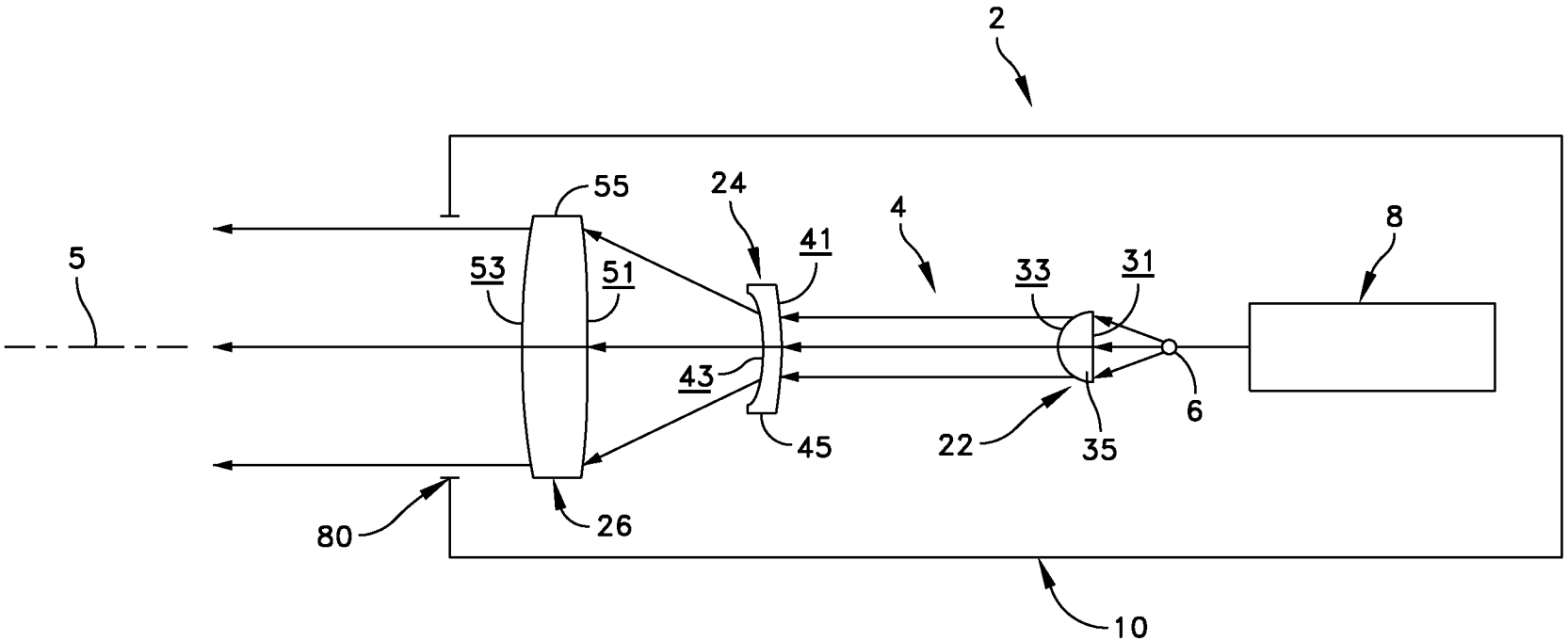
FIG. 3 is a schematic representation of a light source arranged in accordance with one embodiment of the present invention.
Figure 4:
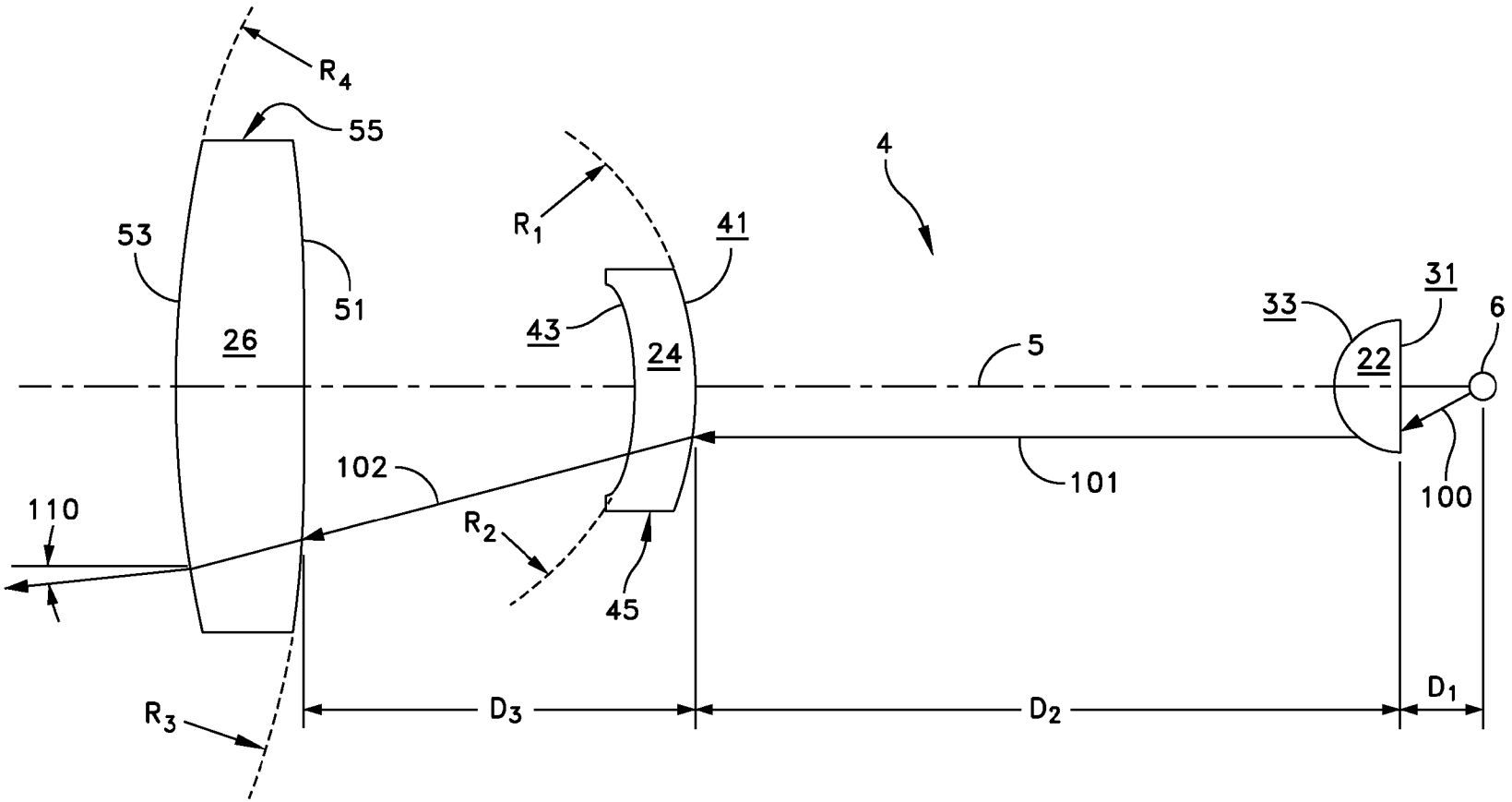
FIG. 4 is a further schematic representation of a light source arranged in accordance with one embodiment of the present invention.
Figure 5:
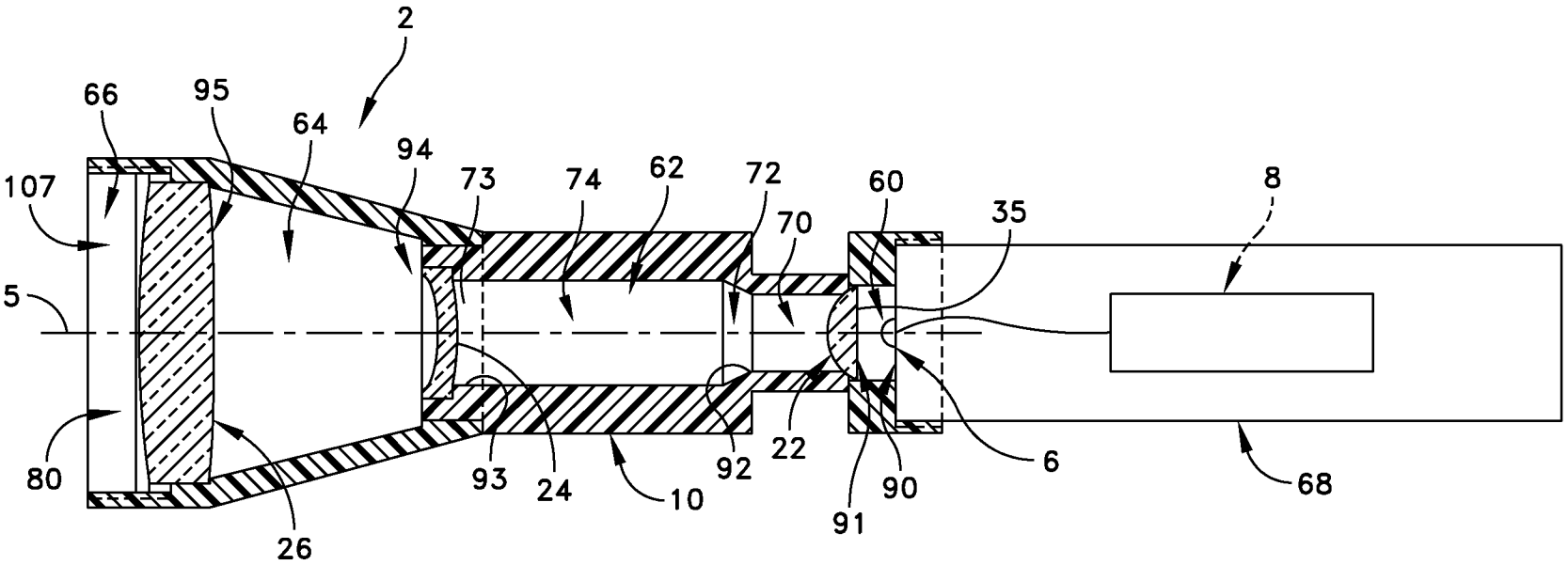
FIG. 5 is a elevational, cross-sectional view a light source arranged in accordance with one embodiment of the present invention.

Referring to FIGS. 3-5, the present invention provides a flashlight 2 including a lens projection system 4, a light source 6, a power supply 8, and a housing 10. Although described as a portable flashlight for convenience, the present invention may be used for a wide variety of illumination purposes including spotlights and searchlights. Lens projecting system 4 comprises a collecting lens 22, a negative lens 24, and a collimating lens 26. Each lens 22, 24, and 26 is aligned along a common central optical axis 5 and mounted within housing 10. Collecting lens 22 defines a first or light gathering surface 31 and a second or light emitting surface 33, that defines a peripheral edge 35. Collecting lens 22 is mounted between light source 6 and negative lens 24. First surface 31 is nearly planar and arranged so as to be substantially perpendicular to optical axis 5. Second surface 33 is generally convex and intersects first surface 31 along peripheral edge 35. In one exemplary embodiment of the invention, collecting lens 22 is plano-convex with an optical focal length of about 17.5 millimeters and an outside diameter of about 18.0 mm.

Negative lens 24 is positioned between the collecting lens 22 and the collimating lens 26, and defines a first surface 41, a second surface 43, and a peripheral edge 45. First surface 41 is generally convex having a first radius of curvature R1 (FIG. 4). Second surface 43 is generally concave having a second radius of curvature R2, wherein R1 is greater than R2. Peripheral edge 45 is generally cylindrical in shape and defines the outer circumferences of the first surface 41 and the second surface 43. In one embodiment of the invention, negative lens 24 is a negative meniscus lens having an optical focal length of −150 mm and an outside diameter of 25.0 mm.

Referring to FIG. 4, collimating lens 26 defines a first surface 51, a second surface 53, and a peripheral edge 55, and is mounted between negative lens 24 and an aperture of housing 10. First surface 51 is generally convex having a radius of curvature R3. Second surface 53 is generally convex having a radius of curvature R4. Preferably, R3 is greater than R4. Peripheral edge 55 is generally cylindrical in shape and defines the outer circumferences of first surface 51 and second surface 53. In one embodiment of the invention, the collimating lens 26 is a biconvex lens having an optical focal length of −132 mm and an outside diameter of 43.9 mm. Lenses 22, 24, 26 may be formed from any suitable optical material having a refractive index in the range of 1.47214 to 1.74605. Such materials may include glass, polymers, etc. In one embodiment of the invention, lenses 22, 24, 26 are formed from BK7 optical glass having a refractive index of 1.47214.

Light source 6 may be mounted within housing 10 generally along optical axis 5 of lens projection system 4. Light source 6 is often located a first distance D1 away from collecting lens 22 along optical axis 5 in such a manner that substantially all luminous radiation emitted by light source 6 falls upon first surface 31 of collecting lens 22. Distance D1 will depend upon the type of light source provided, since each light source emits light at various beam angles. Light source 6 may be any suitable light generating structure, e.g., incandescent, fluorescent, light emitting diode, etc. In one preferred embodiment of the invention, light source 6 comprises a light emitting diode of the type known in the art.

Referring to FIGS. 3-6, housing 10 is shaped and sized so as to enclose and secure lens projecting system 4, light source 6, and power supply 8, while allowing light rays 100,101,102 to travel from light source 6, through light projecting system 4, so as to exit housing 10 via an aperture 107. Housing 10 may be formed from any suitable engineering material, e.g., metal, polymer, rubber, etc., or any combination thereof. Housing 10 generally comprises a plurality of sections 60, 62, 64, 66, 68 centrally disposed about optical axis 5. First section 60 is generally cylindrical in shape having a first end 90 and a second end 91, with light source 6 being mounted adjacent first end 90. Collecting lens 22 is often mounted adjacent to second end 91. In this way, a light ray 100 may travel through first section 60 from light source 6 and through collecting lens 22 adjacent second end 91.

Second section 62 is generally cylindrical in shape having a first end 92 and a second end 93, with collecting lens 22 being mounted adjacent first end 92. Negative lens 24 is often mounted adjacent to second end 93. In this way, a light ray 101 (FIG. 4) may travel through second section 62 by passing through collecting lens 22 adjacent first end 92 and negative lens 24 adjacent second end 93. In one embodiment of the invention, second section 62 comprises three sub-sections 70, 72, 74. Sub-sections 70 and 74 are cylindrical in shape, but often with different diameters. Sub-section 72 is frusto-conical in shape and intersects sections 70 and 74. Third section 64 is generally frusto-conical in shape having a first end 94 and a second end 95, with negative lens 24 being mounted adjacent to first end 94. Collimating lens 26 is mounted adjacent to second end 95. In this way, a light ray 102 (FIG. 4) may divergently travel through third section 64 by entering negative lens 24 adjacent to first end 94, and exiting collimating lens 26 at second end 95. Fourth section 66 forms a rim to prevent damage to collecting lens 26. Housing 10 defines an aperture 80 in fourth section 66. In one embodiment of the invention, aperture 80 may have a diameter of about 50 mm. Fifth section 68 is generally cylindrical in shape and contains power supply 8. Section 68 is adjacent to first section 60 and is sized to accommodate the power supply 8. Power supply 8 is often portable and electrically connected to light source 6. Power supply 8 is not limited to any specific type of battery, i.e., alkaline, NiCad, etc.) and may be selected by one skilled in the art to meet requirements of the invention.

Referring to FIG. 4, lens projection system 4 creates a preferred light path as defined by rays 100,101,102 whereby light from light source 6 is influenced by light projecting system 4 so as to be projected as a highly collimated beam exiting aperture 80 of housing 10. Light source 6 emits light ray 100 which is gathered at first side 31 of collection lens 22. Collecting lens 22 causes ray 100 to bend so that it follows a path that is nearly parallel to optical axis 5, resulting in ray 101. Ray 101 is then projected through negative lens 26, whereby it diverges from optical axis 5, resulting in ray 102. Ray 102 is then collimated by collimating lens 26 and exits aperture 80 at an angle 110 with optical axis 5. In one embodiment of the invention, the collimated beam exiting aperture 80 may have an angle 110 of +/−2.5 degrees with optical axis 5. Advantageously, since all light emitted by light source 6 is gathered by collecting lens 22, the projected beam has uniform brightness at all points throughout its cross section. One embodiment of the invention may have a constant beam angle 110 with first distance D1, between light source 6 and first surface 31 of collection lens 22, being about 19 mm. In such an embodiment, second distance D2, between collection lens 22 and negative lens 24, is about 115 mm, and third distance D3, between the negative lens and the collimating lens, is about 94.4 mm.

Figure 6:
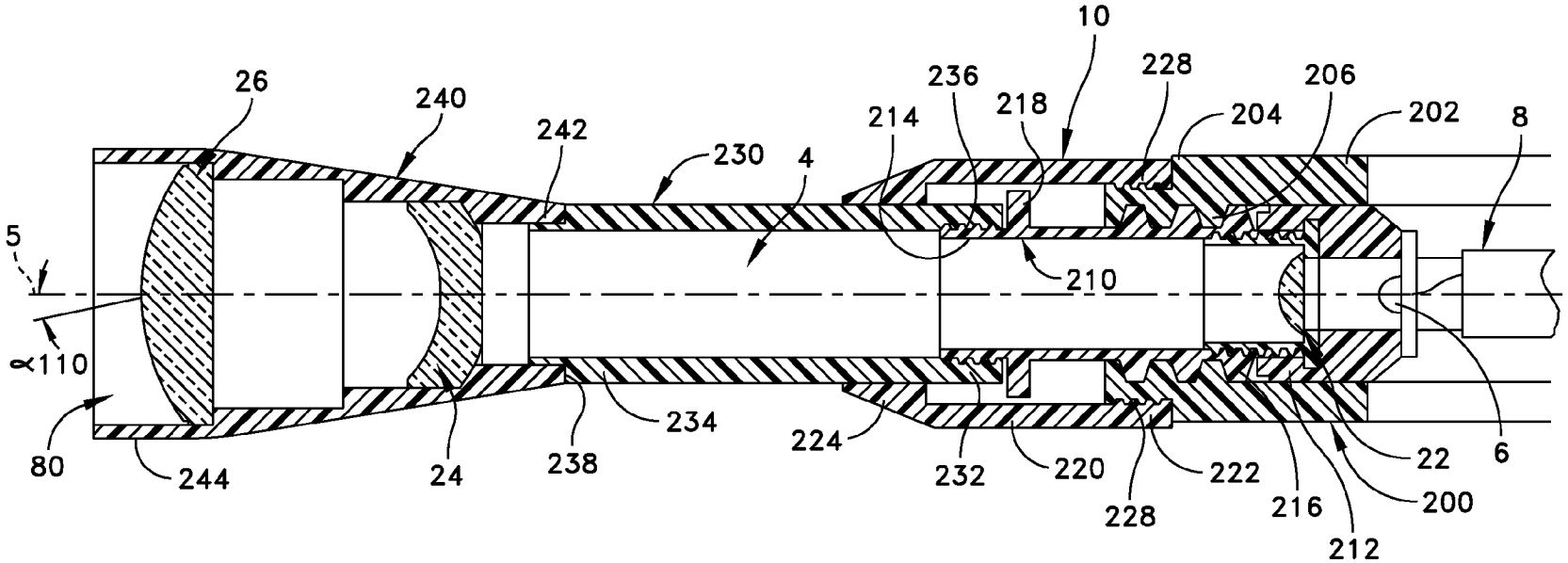
FIG. 6 is a elevational, cross-sectional view a light source arranged in accordance with another embodiment of the present invention.

Referring to FIGS. 4 and 6, an alternative embodiment of the invention provides a flashlight 2 including a lens projection system 4, a light source 6, a power supply 8, and a housing 10. Light source 6 may be adjusted by a distance D1 from the lens projecting system 4, thereby resulting in a variable beam angle 101. First distance D1 may be adjusted between about 2.0 mm to about 11.4 mm, resulting in a beam angle 110 of about 0.25 degrees to 2.5 degrees respectively from optical axis 5.

In the alternative embodiment, lens projecting system 4 comprises a collecting lens 22, a negative lens 24, and a collimating lens 26, wherein each lens is aligned along a central optical axis 5 and mounted within housing 10 along optical axis 5. Collecting lens 22 defines a first surface 31, a second surface 33, and a peripheral edge 35 that is mounted between light source 6 and the negative lens 24.

Light source 6 is mounted within housing 10 generally along optical axis 5 of lens projecting system 4, and is again positioned a first distance D1 away from collecting lens 22 along optical axis 5 in such a manner that all luminous radiation emitted by light source 6 is projected upon first surface 31 of collecting lens 22. In the alternative embodiment of the invention, first distance D1 may be between about 2.0 mm to about 11.4 mm. Also in this alternative embodiment, housing 10 is shaped and sized to enclose and secure lens projecting system 4, light source 6, and power supply 8 while allowing light rays 100,101,102 to travel from light source 6, through light projecting system 4, and finally through an aperture 80 at a variable angle 110. Housing 10, generally comprises a plurality of sections 200, 210, 220, 230, 240 centrally disposed about optical axis 5. Section 200 is generally cylindrical in shape and hollow, having a first end 202 and a second end 204. A thread 206 is formed on the inside surface of section 200 adjacent to first end 202. Light source 6 is located within section 200 adjacent to first end 202.

Referring to FIG. 6, section 210 is generally cylindrical in shape and hollow, having a first end 212 and a second end 214. A thread 216 is formed on the outside surface of section 210 adjacent to first end 212 that matingly complements thread 206. An annular flange 218 projects radially outwardly from the outer surface of section 210 adjacent to second end 214. A collecting lens 22 is mounted adjacent to first end 212 such that light traveling through first end 212 must pass through collecting lens 22. Section 220 is general cylindrical in shape and hollow, having a first end 222 and a frusto-conical second end 224. Section 220 has an internal diameter that is sized to accept annular flange 218 of section 210. A thread 228 is defined on the inner surface of section 220 adjacent to first end 222. Section 230 is generally cylindrical in shape and hollow, having a first end 232 and a second end 234. A thread 236 is defined on the internal surface of section 230 adjacent to a first end 232, and complementary in pitch to a corresponding thread located on the outer surface of second end 214 of section 210. Second end 234 of section 230 includes an annular shoulder 238.

Section 240 is a substantially frusto conical, hollow cylinder having a first end 242 and a second end 244. The inner surface of section 240 comprises a series of recess steps suitable for seating negative lens 24 and collimating lens 26. Second end 234 of section 230 is sized so as to be received within an opening located at first end 242 of section 240 such that section 240 abuts shoulder 238. As a result of this construction, negative lens 24 and collimating lens 26, carried by section 240, may be adjusted along common optical access 5 by movement of sections 210 and 230 relative to section 220.

ADVANTAGES OF THE INVENTION

Numerous advantages are obtained by employing the present invention.

More specifically, a light source is provided which avoids all of the aforementioned problems associated with prior art devices.

Furthermore, a flashlight is provided that generates a collimated beam having a constant brightness throughout its cross-sectional area.

Also, a flashlight is provided that generates a beam of light having a greater intensity at a given distance.

In addition, a flashlight is provided that that reduces the amount of stray light outside of the desired area of illumination region.

It is to be understood that the present invention is by no means limited only to the particular constructions herein disclosed and shown in the drawings, but also comprises any modifications or equivalents within the scope of the claims.

What is claimed is:

1. A light device comprising;

a housing having an aperture;

a power source;

a light source electrically connected to said power source; and a lens projecting system including a collecting lens spaced from a negative lens that is spaced from a collimating lens arranged in series along a common optical axis.

2. A light device according claim 1 wherein the emitting area of said light source is no greater than 2.25 square millimeters.

3. A light device according claim 1 wherein said lens projection system comprises at least three lenses, a closest lens to said light source being a collecting lens.

4. A light device according claim 3 wherein said collecting lens includes a light gathering surface arranged so that all light from said light source falls thereupon.

5. A light device according claim 3 further comprising a negative lens about spaced away from said collecting lens by about 115 millimeters along said common optical axis.

6. A light device according claim 5 further comprising a collimating lens spaced away from said collecting lens.

7. A light device according claim 6 wherein said negative lens is disposed between said collecting and collimating lenses.

8. A light device according claim 7 wherein said collimating lens is disposed at about 49.4 millimeters from said negative lens along said common optical axis.

9. A light device according claim 1 wherein said collecting lens has a focal length of about 17.5 millimeters, said collecting lens has a diameter of about 18 millimeters.

10. A light device according claim 1 wherein said negative lens has a focal length of about −150 millimeters and said negative lens has a diameter of about 18 millimeters.

11. A light device according claim 1 wherein said collimating lens has a focal length of about 132 mm and said collimating lens has a diameter of about 43.9 mm.

12. A light device according claim 11 wherein a beam of light from said projection system produces a homogeneously illuminated substantially circular spot of light, wherein an illuminance is equal in all points of said spot of light.

13. A light device according claim 1 wherein said power supply comprises batteries and means for operatively interconnecting said batteries with said light source.

14. A light device according claim 1 wherein light emitted by said light source is at least one of visible, infrared and ultraviolet spectrum.

15. A light device comprising a power supply a light source and a lens projection system, wherein the lens projection system comprises a collecting lens, a negative lens, and a collimating lens, wherein said collecting lens collects all light from said light source, said negative lens being located at 115 millimeters from said collecting lens between said collecting and said collimating lens, and further wherein said collimating lens is located 49.4 millimeters from said negative lens, such that said collecting lens, negative lens, and collimating lens and said light source are located so as to comprise a common optical axis, and wherein said collecting lens, negative lens, and collimating lens and said light source are at least one of fixed and displaceable relative to one another along said common optical axis with said collecting lens having a focal length of 17.5 millimeters and being 18 millimeters in diameter, said negative lens having a focal length of −150 millimeters and being 25 millimeters in diameter, said collimating lens having a focal length of 132 millimeters and having a diameter of about 43.9 millimeters.

16. A light device according claim 15 wherein a beam angle of said beam projected by said light device is fixed and depends upon the distance between said collecting lens and said light source.

17. A light device according claim 16 wherein said beam angle is adjustable by displacing said lens projection system and said light source relative to one another along said common optical axis.

18. A light device according claim 15 wherein the illuminance of an area illuminated by a beam projected by said light device is homogeneous throughout the whole illuminated area.

19. A light device according claim 18 wherein the shape of a light spot produced by said beam substantially circular.

20. A light device according claim 18 wherein a beam angle of a light beam projected by said lens projection system is about +/−2.5 degrees.

* * * * *